US005329495A

United States Patent [19]

Zehner

[11] Patent Number: 5,329,495

[45] Date of Patent: Jul. 12, 1994

[54] PASSIVE BEAMFORMER WITH LOW SIDE LOBES

[75] Inventor: William J. Zehner, Lynn Haven, Fla.

[73] Assignee: The United States of America as represented by the Secretary of the Navy, Washington, D.C.

[21] Appl. No.: 83,600

[22] Filed: Jun. 30, 1993

[51] Int. Cl.[5] ..... H04R 17/00

[52] U.S. Cl. ..... 367/138; 367/154; 367/905

[58] Field of Search ..... 367/905, 138, 154, 103, 367/105, 119; 342/154, 354

[56] References Cited

U.S. PATENT DOCUMENTS 4,291,396 9/1981 Martin ..... 367/905

*Primary Examiner*—Daniel T. Pihulic

*Attorney, Agent, or Firm*—William C. Townsend; Edward J. Connors, Jr.

[57] ABSTRACT

A pulsed-transmission, narrow-band sonar system has a first antenna array which is unshaded and a second array partitioned into four parts, the center two of which are electrically connected in parallel and the outer two of which are connected in series.

2 Claims, 2 Drawing Sheets

PASSIVE BEAMFORMER WITH LOW SIDE LOBES

DESCRIPTION OF THE INVENTION

This invention relates to pulsed-transmission, narrowband, echo ranging sonar systems and more particularly to the arrays used to form the acoustic beams.

The principal objective of this invention is to produce an acoustic beam with side lobes in the composite (transmit-receive) beam suppressed at least 40 dB.

A second objective is to create the composite pattern by passive means (without the use of active circuits for shading).

A further objective is to obtain the desired pattern with a minimum of complexity.

Another objective is to create the response without the use of resistors or transformers or other electrical components.

DETAILED DESCRIPTION OF THE PREFERRED EMBODIMENTS

For many sonar applications, it is desirable to reject or reduce the amount of energy received by an acoustic array from directions other than the main response axis (MRA). The one-way target response (beam pattern) of an unshaded line array is:

$$P_1(\theta) = \frac{\sin(x)}{x}, \text{ where} \tag{1}$$

$$x = \frac{\pi L_S}{\lambda} \sin\theta$$

Figure 1:
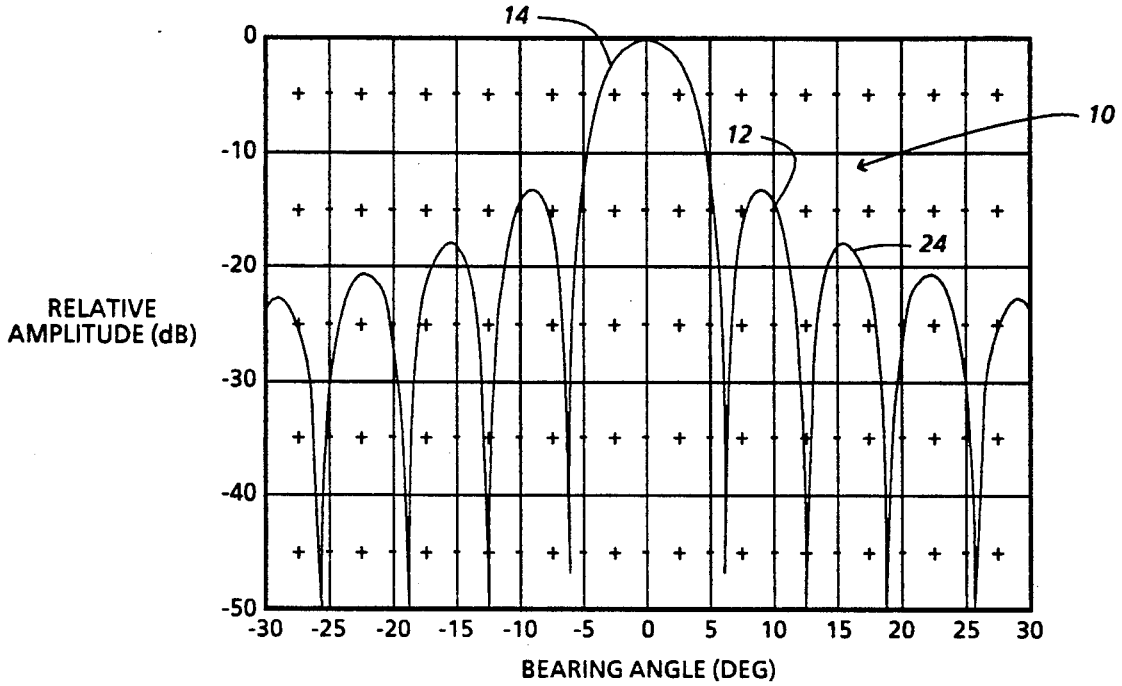
FIG. 1 is a graphic showing a sin(x)/x beam pattern.

$L_S$=arraylength
$\lambda$=c/f=wavelength
$\theta$=angle relative to MRA
f=signalfrequency As shown in FIG. 1, this pattern has significant energy in the secondary lobes. The highest of these side lobes is only 13 dB below the MRA response. The composite (transmit-receive) response of a sonar is the product of the transmitter beam response and the receiver beam response, so that if the same array is used (or identical arrays) are used for transmission and reception, the composite response is then:

$$P_2(\theta) = \left(\frac{\sin(x)}{x}\right)^2, \tag{2}$$

and the secondary response is then 26 dB below the MRA response in the composite pattern. In some cases, this amount of rejection may be sufficient, but in most cases, greater rejection is required.

It will be evident to those skilled in the art that a large class of shading functions (also called window functions, weighting functions, etc.) can be used to suppress side lobes in either frequency-domain or spatial-domain signal processing. However, all such processes require that the signals one each element of the projector (or hydrophone) array be multiplied by a scalar weight calculated from the selected shading function. The multiplication requires some circuitry or computational function (such as resistor weighting, operational amplifier summing, multiple-tap transformers, etc.) for implementation.

The new method requires no circuitry. Instead, two separate and slightly different sized arrays are used for transmitting and receiving, and their relative lengths are selected in a particular way so that their composite response has minimal side lobe levels.

Figure 2:
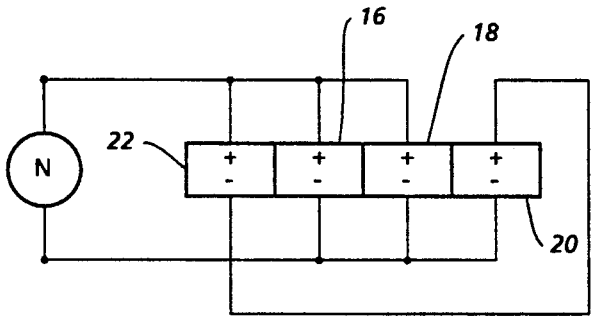
FIG. 2 is showing of four element array according to this invention.

One array is uniformly weighted (or unshaded) of length $L_S$. The other array, of length $L_B$, is partitioned into four equal parts and wired in a special way which will be well known to those skilled in the art as bizonally shaded. It is the only known shading function (actually it is a special case of the Fejer window for N=4) that can be accomplished simply by the way in which the stave elements are electrically connected to each other. As shown in FIG. 2, the center two elements are connected in parallel thus receiving equal voltage, and the end elements are wired in series, so that each receives one half of the voltage applied to the center elements. No transformers or resistors are required.

The presence response of a bizonally-shaded array is given by:

$$P_3(\theta) = \frac{3}{8}\left[\frac{\sin(x)}{x} + \frac{1}{2}\,\frac{\sin(x/2)}{(x/2)}\right], \text{ where} \tag{3}$$

$$x = \frac{\pi L_B}{\lambda} \sin\theta$$

Figure 3:
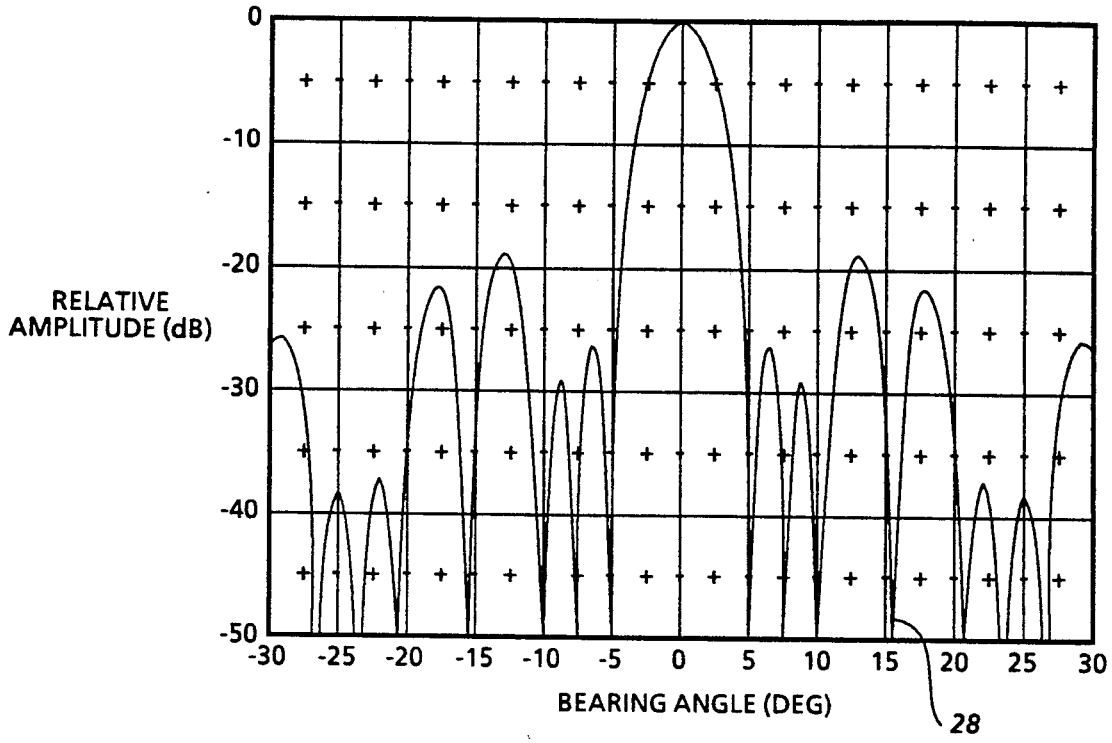
FIG. 3 is graphic showing of a bizonally shaded array pattern.

This response is illustrated in FIG. 3.

Figure 4:
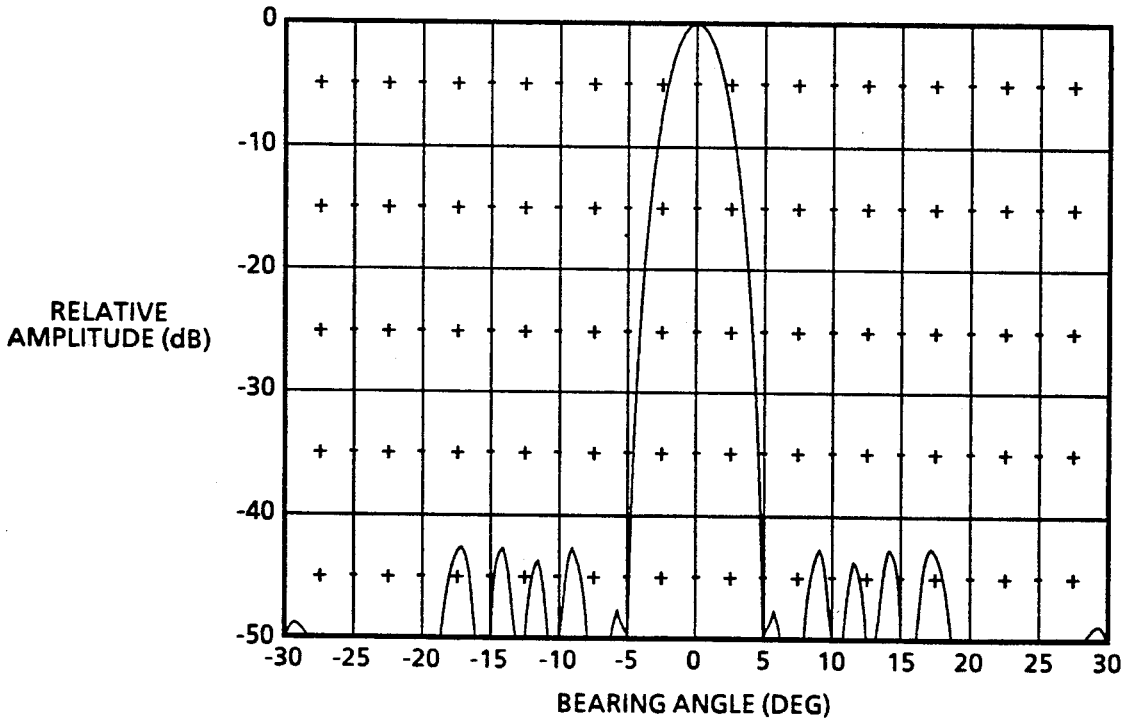
FIG. 4 is a graphic showing of a composite projecting-receive pattern.

The key to the new design can be derived by comparing FIG. 3 with FIG. 1. Observe that if the peak of the second side lobe of the sin(x)/x function (FIG. 1) can be made to coincide with the fourth null in the bizonal pattern (FIG. 3), the result will have side lobe rejection greater than 43 dB, as shown in FIG. 4. Thus, setting $x=5\pi/2$ in equation 1 and $x=4\pi$ in equation 3 and solving simultaneously for $\sin\theta$ results in:

$$L_B = 8/5 L_S$$

That is, the bizonally-shaded array must have a length about 60 percent longer than the unshaded array.

It will be evident to those skilled in the art that either of these arrays can serve as the projector with the other serving as hydrophone, and that the principle is applicable to cylindrical arrays as well as line arrays. It will also be evident that the principle applies equally to radar and sonar arrays.

I claim:

1. Apparatus for reducing the effective side lobe level of a multi-element directional antenna system used to transmit and receive propagated signals comprising, a first array of elements having uniform shading and a second array of elements partitioned into a plurality of equal parts, the parts being electrically connected so that the second array is bizonally shaded, the second array being approximately 60 percent longer than the first array.

2. Apparatus as set forth in claim 1 in which the center elements of the second array are connected in parallel.

* * * * *